US008480543B1

(12) United States Patent
Leier et al.

(10) Patent No.: US 8,480,543 B1
(45) Date of Patent: Jul. 9, 2013

(54) SUPPORTING DEVICE FOR WAIST OR NECK PORTION

(75) Inventors: Christopher Henry Leier, E. Puyallup, WA (US); Howard Paul Schultz, E. Puyallup, WA (US)

(73) Assignee: Expectations, LLC, Puyallup, WA (US)

( * ) Notice: Subject to any disclaimer, the term of this patent is extended or adjusted under 35 U.S.C. 154(b) by 0 days.

(21) Appl. No.: 13/598,820

(22) Filed: Aug. 30, 2012

(51) Int. Cl.
*A63B 22/00* (2006.01)

(52) U.S. Cl.
USPC ..... 482/51; 5/632

(58) Field of Classification Search
USPC ..... 5/632, 636, 640, 644, 630; 602/32, 602/36; 482/142, 140, 51
See application file for complete search history.

(56) References Cited

U.S. PATENT DOCUMENTS 4,299,211 A * 11/1981 Doynow ..... 602/19
5,211,185 A * 5/1993 Garth et al. ..... 5/628
5,743,832 A 4/1998 Sands et al.
5,794,286 A 8/1998 Scott et al.
6,637,055 B1 10/2003 Nanan

* cited by examiner

*Primary Examiner* — Fredrick Conley
(74) *Attorney, Agent, or Firm* — Charles E. Baxley

(57) ABSTRACT

A supporting device includes a planar member having two end portions and an outer peripheral portion, and a fastening device attached to the end portions of the planar member for adjusting and maintaining the planar member at a curved structure and for engaging with and supporting or massaging various portions of the user. The fastening device includes a flexible member for being coupled between the end portions of the planar member, a buckle attached to one end portion of the flexible member, and a locking member attached to the other end portion of the flexible member for attaching the flexible member to the end portions of the planar member.

8 Claims, 5 Drawing Sheets

SUPPORTING DEVICE FOR WAIST OR NECK PORTION

BACKGROUND OF THE INVENTION

1. Field of the Invention

The present invention relates to a supporting device, and more particularly to a supporting device for selectively engaging with the waist portion or the neck portion of a user and for suitably supporting and/or massaging the waist portion or the neck portion of the user, and including a structure for easily and quickly and readily attaching or mounting or securing onto various supporting objects or mechanisms or facilities.

2. Description of the Prior Art

Typical exercisers, such as the tilting inversion exercisers comprise a flat table or bench pivotally or rotatably attached or mounted or secured or supported on a supporting stand and pivotal or rotatable relative to the supporting stand between an upright or head up resting position and an inverted or head down working or exercising position for conducting exercising or rehabilitation purposes.

For example, U.S. Pat. No. 5,743,832 to Sands et al., U.S. Pat. No. 5,794,286 to Scott et al., and U.S. Pat. No. 6,637,055 to Nanan disclose several of the typical tilting inversion exercisers or rehabilitation exercisers each also comprising a flat table or bench pivotally or rotatably attached or mounted or secured or supported on a supporting stand for suitably supporting the user thereon, and may further include a head frame or head rest attached or mounted or secured onto the table or bench for supporting the head of the user.

However, the head frame or head rest is solidly and stably attached or mounted or secured onto the table or bench and may not be removed from the table or bench and also may not attached or mounted or secured onto the other portion of the table or bench for supporting the other portion of the user, such as the waist portion or the neck portion of the user.

In addition, no other supporting devices have been developed and provided for engaging with and for suitably supporting and/or massaging various portions of the user, such as the waist portion or the neck portion of the user.

The present invention has arisen to mitigate and/or obviate the afore-described disadvantages of the conventional supporting devices for users.

SUMMARY OF THE INVENTION

The primary objective of the present invention is to provide a supporting device for selectively engaging with the waist portion or the neck portion of a user and for suitably supporting and/or massaging the waist portion or the neck portion of the user.

The other objective of the present invention is to provide a supporting device including a structure for easily and quickly and readily attaching or mounting or securing onto various supporting objects or mechanisms or facilities, such as the tilting inversion exercisers.

In accordance with one aspect of the invention, there is provided a supporting device comprising a planar member including a first end portion and a second end portion, and an outer peripheral portion, and a fastening device attached to the first and the second end portions of the planar member for adjusting and maintaining the planar member at a curved structure and for selectively engaging with various portions of the user and for suitably supporting and/or massaging the various portions of the user, such as the waist portion or the neck portion of the user.

The fastening device includes a flexible member for being coupled between the first and the second end portions of the planar member, a buckle attached to a first end portion of the flexible member, and a locking member attached to a second end portion of the flexible member for attaching and securing the flexible member to the first and the second end portions of the planar member. The locking member may be selected from a hook and loop fastening element.

The planar member includes a groove formed in each of the first and the second end portions of the planar member for engaging with the flexible member, and the flexible member of the fastening device is engaged through the grooves of the first and the second end portions of the planar member for positioning and maintaining the planar member at the upwardly curved or bent or folded structure.

The planar member includes a number of openings formed through the planar member for air circulation purposes or the like. The openings of the planar member are extended from the first end portion toward the second end portion of the planar member for allowing an intermediate portion of the planar member to be easily curved or bent or folded upwardly. The planar member includes a number of orifices formed in the outer peripheral portion of the planar member for air circulation purposes or the like.

A table may further be provided for supporting the planar member. The table includes two apertures formed therein, and the fastening device includes a flexible member engaged through the apertures of the table for mounting the planar member to the table. The planar member may also be randomly disposed or supported on the table at any selected or predetermined or suitable position or location without securing to the table. A supporting stand may further be provided for pivotally supporting the table and for acting as a tilting inversion exerciser or a rehabilitation facility.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
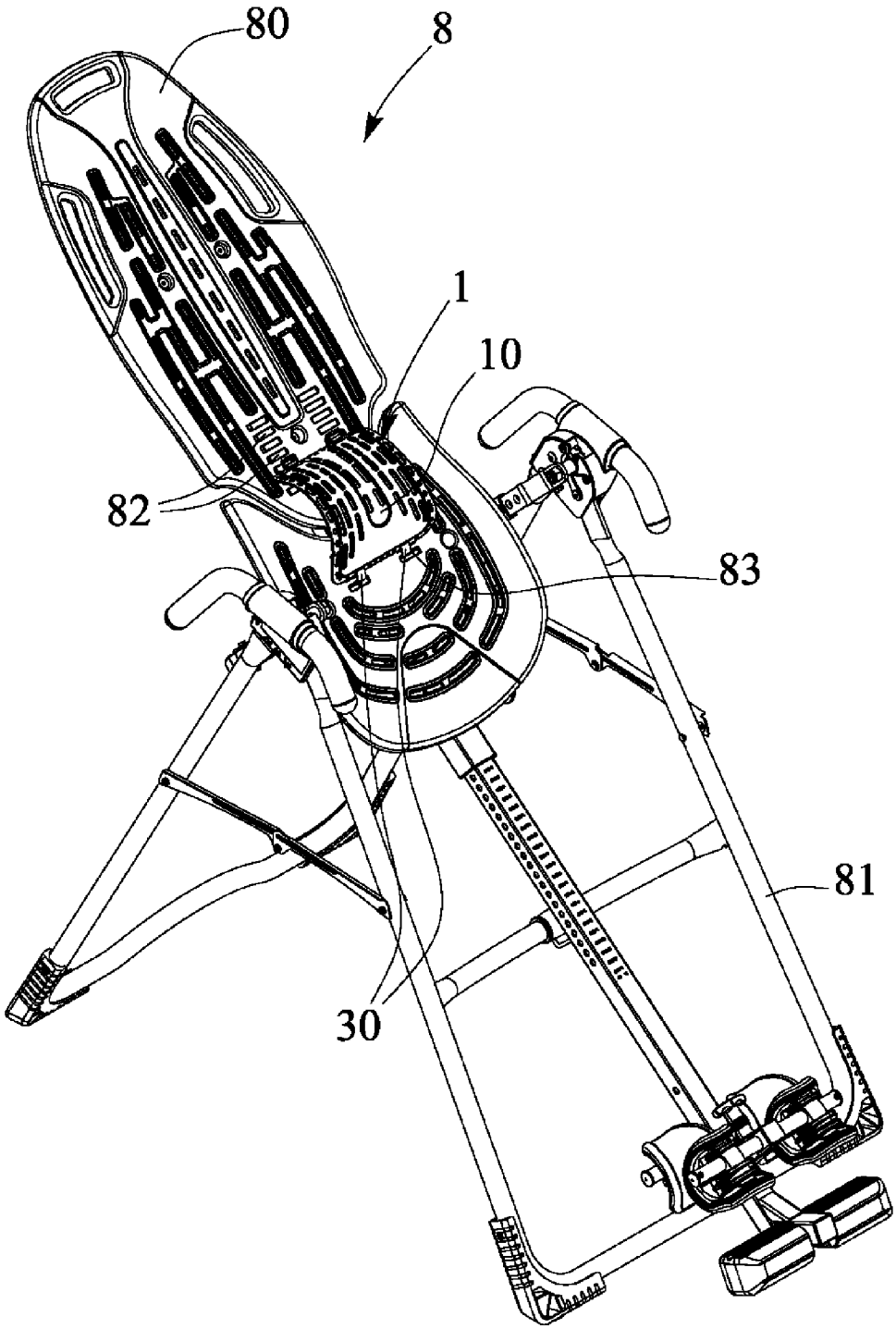
FIG. 1 is a perspective view illustrating an operation of a supporting device in accordance with the present invention for attaching or mounting or securing onto an exerciser or various supporting objects or mechanisms or facilities, such as the tilting inversion exerciser.
Figure 3:
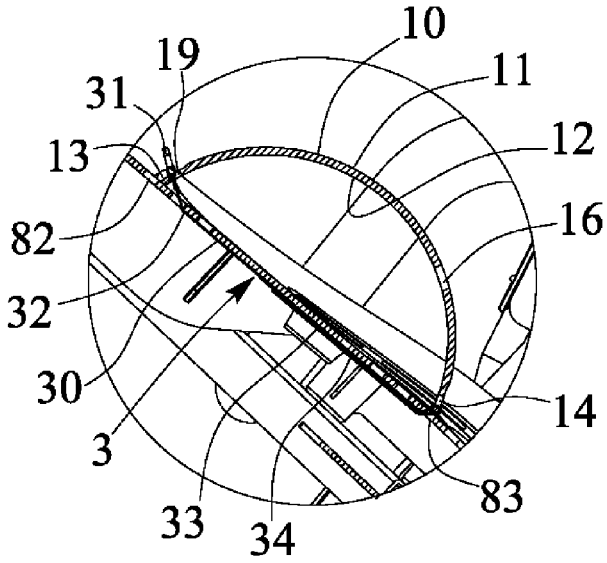
FIG. 3 is an enlarged partial side plan schematic view of the tilting inversion exerciser and the supporting device.
Figure 2:
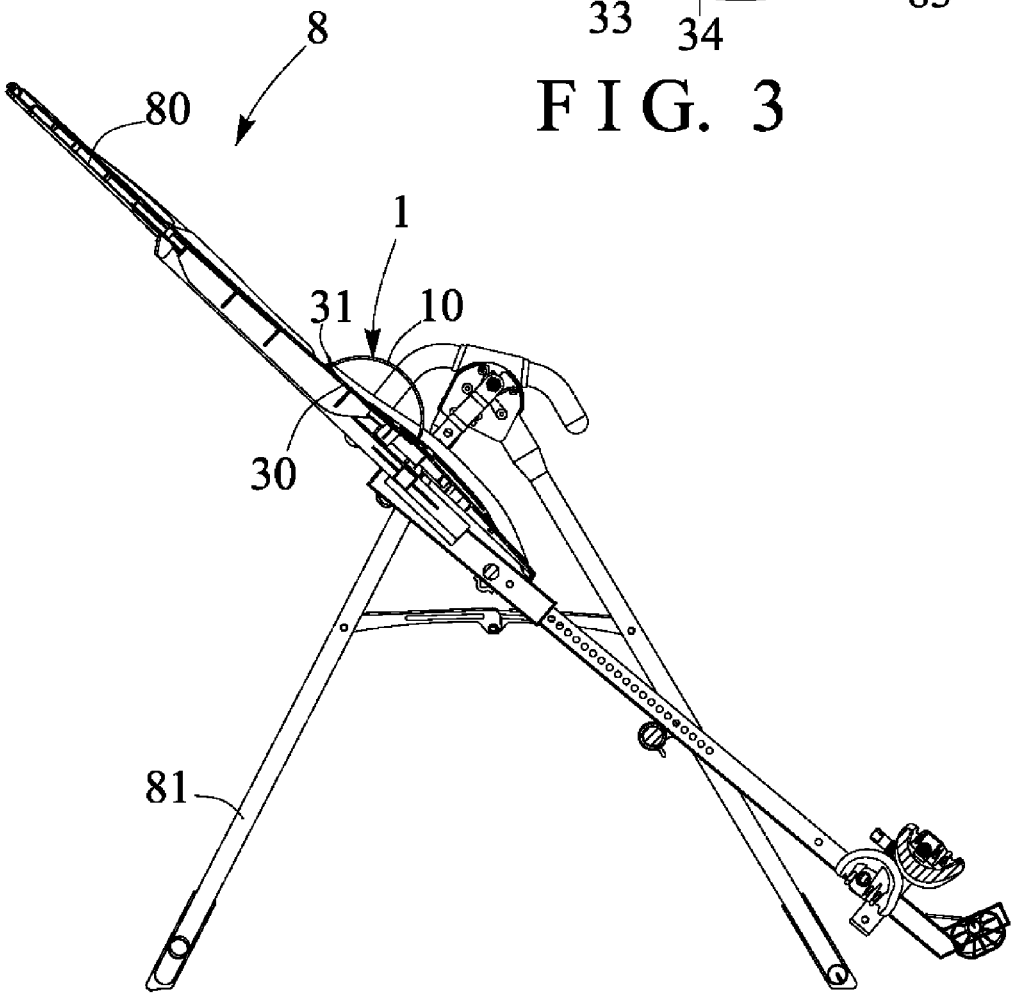
FIG. 2 is a side plan schematic view of the tilting inversion exerciser having the supporting device disposed or attached or mounted or secured thereon.

Referring to the drawings, and initially to FIGS. 1-3, a supporting device 1 in accordance with the present invention includes a structure provided for selectively and easily and quickly and readily attaching or mounting or securing onto various supporting objects or mechanisms or facilities 8, such as the tilting inversion exerciser 8 which includes a board or bench or flat table 80 pivotally or rotatably attached or mounted or secured or supported on a supporting stand 81 for suitably supporting a user thereon, and pivotal or rotatable relative to the supporting stand 81 between an upright or head up resting position and an inverted or head down working or exercising position for conducting various exercising or rehabilitation purposes, and the table 80 may further include a number of openings or orifices or apertures 82, 83 formed or provided therein for air circulating purposes and/or for selectively attaching or mounting or securing the supporting device 1 onto the table 80.

Figure 4:
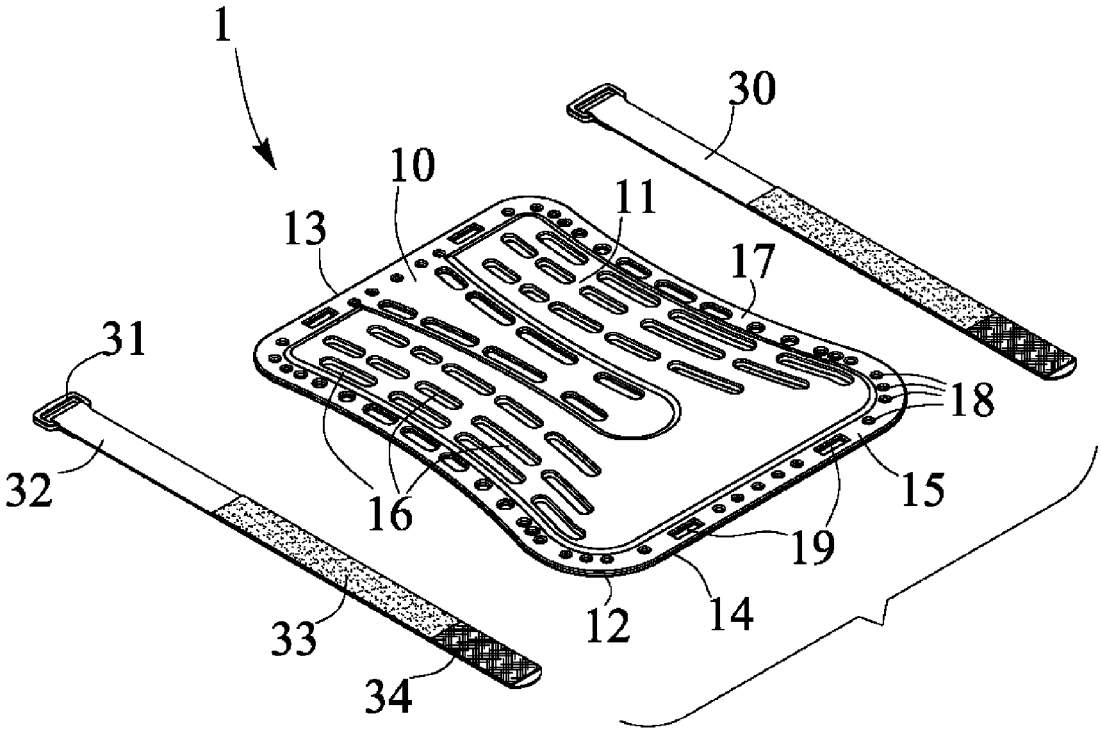
FIG. 4 is an exploded view of the supporting device.
Figure 5:
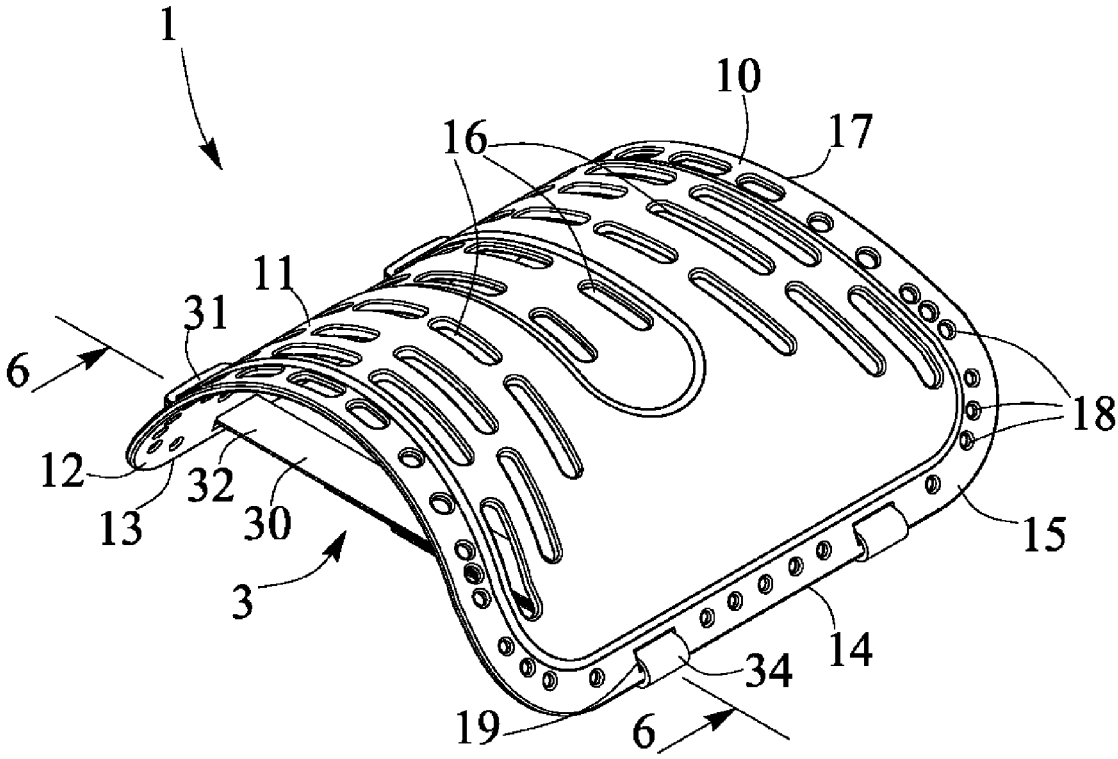
FIG. 5 is a perspective view of the supporting device.
Figure 6:
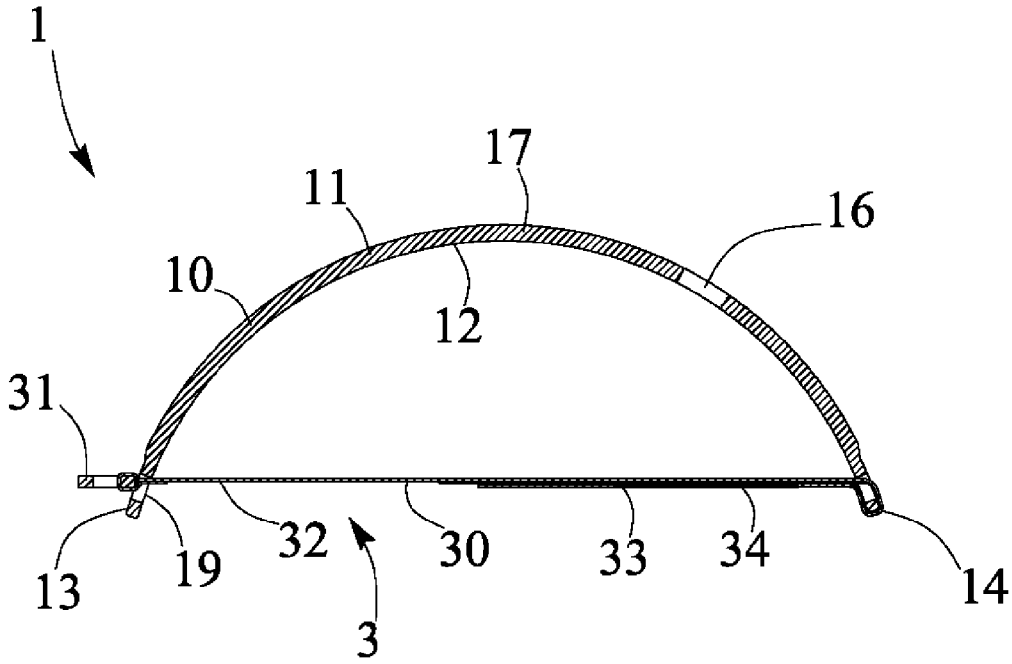
FIG. 6 is a cross sectional view of the supporting device, taken along lines 6-6 of FIG. 5.

The above-described structure or configuration for the table 80 and the supporting stand 81 of the tilting inversion exerciser 8 is typical and will not be described in further details. The supporting device 1 may be provided for attaching or mounting or securing onto various portions or positions or locations of the table 80 for suitably engaging with and for supporting and/or massaging the waist portion and/or the neck portion of the user 88 (FIG. 8), or the like. Referring next to FIGS. 4-6, the supporting device 1 comprises a plate or board or planar member 10 including an upper portion or surface 11 and a bottom portion or surface 12, a first end portion 13 and a second end portion 14, and an outer peripheral portion 15, and including a number of oblong holes or slots or channels or openings 16 formed through the planar member 10 and communicating with the upper portion or surface 11 and the bottom portion or surface 12 of the planar member 10 for air permeating or circulating purposes or the like.

It is preferable that the openings 16 are formed and extended longitudinally along or relative to the planar member 10 and extended or directed from the first end portion 13 toward the second end portion 14 of the planar member 10 for allowing the middle or intermediate portion 17 of the planar member 10 to be easily curved either downwardly or upwardly. The planar member 10 may further include a number of holes or slots or channels or openings or apertures or orifices 18 formed in the outer peripheral portion 15 thereof for air circulating purposes or the like, and may further include one or more (such as two) grooves 19 formed in the outer peripheral portion 15 thereof at each of the first and the second end portion 13, 14 of the planar member 10 respectively for air circulating purposes and/or for attaching or mounting or securing the other objects or mechanisms or facilities onto the planar member 10 selectively.

The supporting device 1 further includes one or more (such as two) connecting or coupling or tightening or fastening members or devices 3, such as fastening belts 3 each having a longitudinal bar or belt or flexible member 30 for being coupled between the first and the second end portions 13, 14 of the planar member 10, a buckle 31 attached or mounted or secured or coupled to one or first end portion 32 of the flexible member 30, and a latching or catching or locking member 33, such as the hook and loop fastening element 33 attached or mounted or secured or applied onto the other or second end portion 34 of the flexible member 30, and the flexible member 30 is allowed to thread or engage with or engage through the grooves 19 of the planar member 10, and the buckle 31 of the fastening device 3 includes a size or height or width or dimension greater than that of the grooves 19 of the planar member 10 and may not be moved or engaged through the grooves 19 of the planar member 10 for anchoring or positioning or mounting or retaining the buckle 31 of the fastening device 3 to the planar member 10 (FIGS. 2-3 and 6-7).

Figure 7:
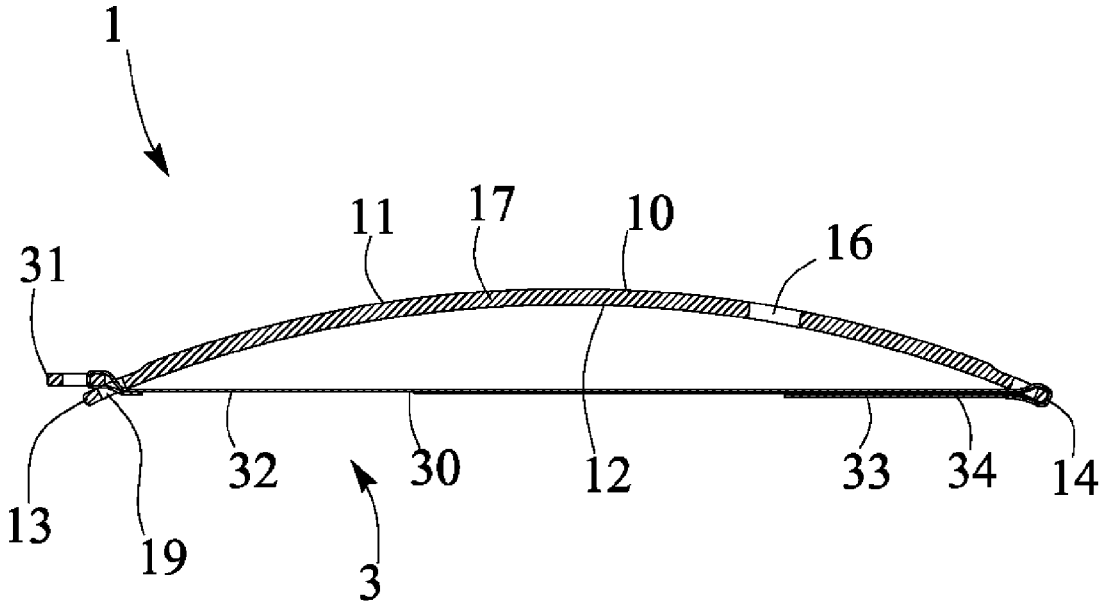
FIG. 7 is another cross sectional view similar to FIG. 6, illustrating the operation of the supporting device.
Figure 8:
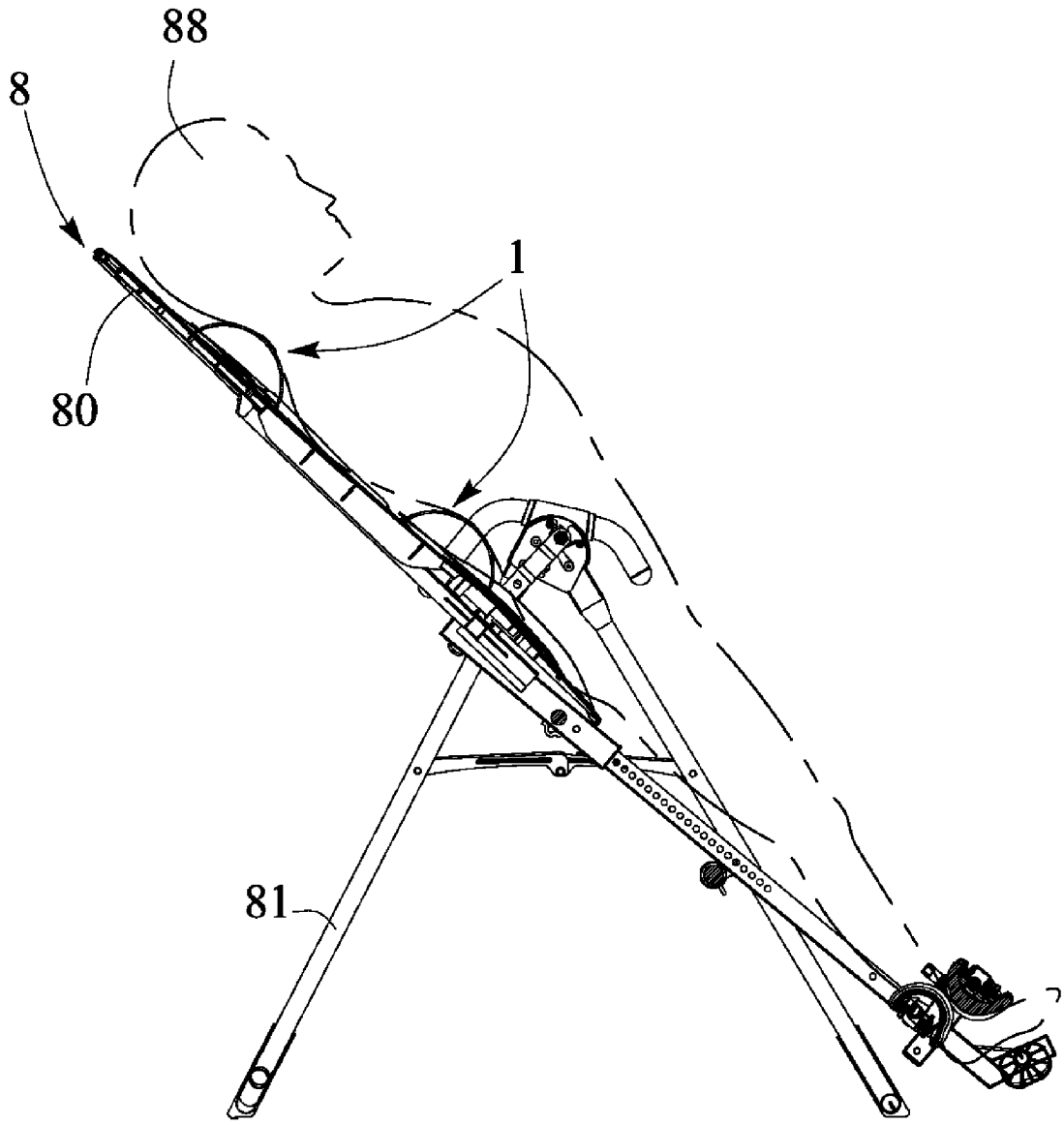
FIG. 8 is another side plan schematic view similar to FIG. 2, illustrating the operation of the supporting device.

In operation, as shown in FIGS. 5-7, the other or second end portion 34 of the flexible member 30 may first be threaded or engaged with or engaged through either of the grooves 19 at the first end portion 13 of the planar member 10, and then may be threaded or engaged with or engaged through either of the grooves 19 at the other or second end portion 14 of the planar member 10, and the other or second end portion 34 of the flexible member 30 may then be bent or folded to have the hook and loop fastening element or the locking member 33 at the other or second end portion 34 of the flexible member 30 to be faced and directed toward each other and to be engaged with each other for adjusting and anchoring or retaining or positioning or maintaining the planar member 10 at the selected or predetermined curvature or curved structure (FIGS. 6, 7) and for selectively engaging with the waist portion or the neck portion of the user 88 (FIG. 8).

As shown in FIGS. 1-3, the flexible member 30 may further be threaded or engaged with or engaged through the apertures 82, 83 of the table 80 for attaching or mounting or securing the planar member 10 to the selected or predetermined positions or locations of the table 80 and thus for selectively engaging with the waist portion or the neck portion of the user and thus for suitably supporting and/or massaging the waist portion or the neck portion of the user 88 (FIG. 8). It is to be noted that the flexible members 30 may easily and quickly and readily attach or mount or secure the planar member 10 to the table 80 at any selected or predetermined or suitable positions or locations for selectively engaging with or supporting and/or massaging various portions of the user. Or, the planar member 10 may also be removed or disengaged from the table 80; i.e., the flexible member 30 is not threaded or engaged with or engaged through the apertures 82, 83 of the table 80, and the planar member 10 may be disposed or located or supported on the table 80 at any selected or predetermined position or location by the user for suitably and selectively engaging with various selected portions of the user and thus for suitably supporting and/or massaging the waist portion or the neck portion of the user 88 (FIG. 8).

Accordingly, the supporting device in accordance with the present invention is provided for selectively engaging with the waist portion or the neck portion of a user and for suitably supporting and/or massaging the waist portion or the neck portion of the user, and includes a structure for easily and quickly and readily attaching or mounting or securing onto various supporting objects or mechanisms or facilities, such as the tilting inversion exercisers or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A supporting device comprising:

a planar member including a first end portion and a second end portion, and an outer peripheral portion, a fastening device attached to said first and said second end portions of said planar member for adjusting and maintaining said planar member at a curved structure, and a table for supporting said planar member, said table including two apertures formed therein, and said fastening device including a flexible member engaged through said apertures of said table for mounting said planar member to said table.

2. The supporting device as claimed in claim 1, wherein said fastening device includes a flexible member for being coupled between said first and said second end portions of said planar member, a buckle attached to a first end portion of said flexible member, and a locking member attached to a second end portion of said flexible member for attaching said flexible member to said first and said second end portions of said planar member.

3. The supporting device as claimed in claim 2, wherein said locking member is selected from a hook and loop fastening element.

4. The supporting device as claimed in claim 2, wherein said planar member includes a groove formed in each of said first and said second end portions of said planar member for engaging with said flexible member, and said flexible member of said fastening device is engaged through said grooves of said first and said second end portions of said planar member for maintaining said planar member at the curved structure.

5. The supporting device as claimed in claim 1, wherein said planar member includes a plurality of openings formed through said planar member.

6. The supporting device as claimed in claim 5, wherein said openings of said planar member are extended from said first end portion toward said second end portion of said planar member for allowing an intermediate portion of said planar member to be curved upwardly.

7. The supporting device as claimed in claim 1, wherein said planar member includes a plurality of orifices formed in said outer peripheral portion of said planar member.

8. The supporting device as claimed in claim 1 further comprising a supporting stand for supporting said table.

* * * * *